US009737983B2

(12) United States Patent
Muuttonen et al.

(10) Patent No.: US 9,737,983 B2
(45) Date of Patent: Aug. 22, 2017

(54) PERCUSSION PISTON

(71) Applicant: SANDVIK MINING AND CONSTRUCTION OY, Tampere (FI)

(72) Inventors: Timo Muuttonen, Tampere (FI); Antti Koskimäki, Tampere (FI); Ari Kotala, Tampere (FI); Timo Leino, Tampere (FI)

(73) Assignee: SANDVIK MINING AND CONSTRUCTION OY, Tampere (FI)

( * ) Notice: Subject to any disclaimer, the term of this patent is extended or adjusted under 35 U.S.C. 154(b) by 8 days.

(21) Appl. No.: 14/945,950

(22) Filed: Nov. 19, 2015

(65) Prior Publication Data

US 2016/0144498 A1 May 26, 2016

(30) Foreign Application Priority Data

Nov. 20, 2014 (EP) ..... 14194091

(51) Int. Cl.

*B25D 9/18* (2006.01)
*B25D 17/06* (2006.01)
*E21B 1/00* (2006.01)

(52) U.S. Cl.

CPC ..... *B25D 9/18* (2013.01); *B25D 17/06* (2013.01); *E21B 1/00* (2013.01); *B25D 2217/0023* (2013.01)

(58) Field of Classification Search

CPC .. E21B 1/00; B25D 9/18; B25D 17/06; B25D 2217/0023

See application file for complete search history.

(56) References Cited

U.S. PATENT DOCUMENTS

| | | | | | |
|---|---|---|---|---|---|
| 746,343 | A | | 12/1903 | Krohn | |
| 997,698 | A | | 7/1911 | Penberthy | |
| 1,035,117 | A | | 8/1912 | Gilman | |
| 1,680,250 | A | | 8/1928 | Allen | |
| 1,895,153 | A | | 1/1933 | Feucht | |
| 2,141,727 | A | | 12/1938 | Slater | |
| 4,028,995 | A | * | 6/1977 | Salmi | B25D 9/12 91/276 |
| 4,070,949 | A | * | 1/1978 | Salmi | B25D 9/20 91/276 |
| 4,355,691 | A | * | 10/1982 | Karru | E21B 6/00 173/106 |

(Continued)

FOREIGN PATENT DOCUMENTS

| | | |
|---|---|---|
| CN | 1231379 A | 10/1999 |
| CN | 1678432 A | 10/2005 |

*Primary Examiner* — Thomas E Lazo
(74) *Attorney, Agent, or Firm* — Corinne R. Gorski

(57) ABSTRACT

A percussion piston for a rock drill machine having a pilot cylinder, a distributor and a pressure medium includes a control edge configurable to cause a change in the position of the distributor in a direction parallel to the axial direction of the percussion piston as the percussion piston moves in the impact direction (A) in relation to the pilot cylinder. The control edge of the percussion piston includes at least one notch provided on the outer periphery of the control edge and arranged to cause a start of a state change for the distributor before the control edge of the percussion piston passes by a corresponding control edge provided on the distributor or pilot cylinder.

14 Claims, 3 Drawing Sheets

(56) References Cited

U.S. PATENT DOCUMENTS

| | | | | |
|---|---|---|---|---|
| 4,817,737 | A * | 4/1989 | Hamada | B25D 9/145 173/115 |
| 5,884,713 | A * | 3/1999 | Shinohara | B06B 1/183 173/206 |
| 6,609,577 | B2 | 8/2003 | Rainer | |
| 6,877,569 | B2 * | 4/2005 | Koskimaki | B25D 9/18 173/1 |
| 2010/0059242 | A1 * | 3/2010 | Koskimaki | B25D 9/20 173/201 |

* cited by examiner

PERCUSSION PISTON

RELATED APPLICATION DATA

This application claims priority under 35 U.S.C. §119 to EP Patent Application No. 14194091.6, filed on Nov. 20, 2014, which the entirety thereof is incorporated herein by reference.

TECHNICAL FIELD

The present disclosure relates to percussion pistons and a method for changing a state of a distributor of a rock drilling machine.

BACKGROUND

Control edges are used in rock drilling machines to couple the timing of work phase changes or state changes to the position of the percussion piston in relation to the cylinder. This can be achieved by the control edges controlling the flow of pressure medium in the hydraulic system of the rock drilling machine. However, to provide a sufficient reliability ensuring functioning of the rock drilling machine at all occasions, rock drilling machines may require a considerable so called advance. This means that a control edge of the percussion piston passes by a corresponding control edge of the cylinder or distributor before an optimal impact point of the percussion piston. This causes the distributor to start moving, which starts to close a pressure channel connected to the work space before the actual impact takes place. If the impact point moves for some reason, at some point a tank pressure (low pressure) may even exist in the work space, when the percussion piston is still moving towards the impact point. This causes cavitation in work space causing erosion.

SUMMARY

The present disclosure provides a method and a percussion piston for implementing the method. The disclosure is based on forming a control edge of the percussion piston in such a way that pressure medium can flow through notches provided on a control edge of the percussion piston before the actual control edge of the percussion piston passes by a corresponding control edge provided on a pilot cylinder or the distributor.

The foregoing summary, as well as the following detailed description of the embodiments, will be better understood when read in conjunction with the appended drawings. It should be understood that the embodiments depicted are not limited to the precise arrangements and instrumentalities shown.

DETAILED DESCRIPTION

Figure 1:
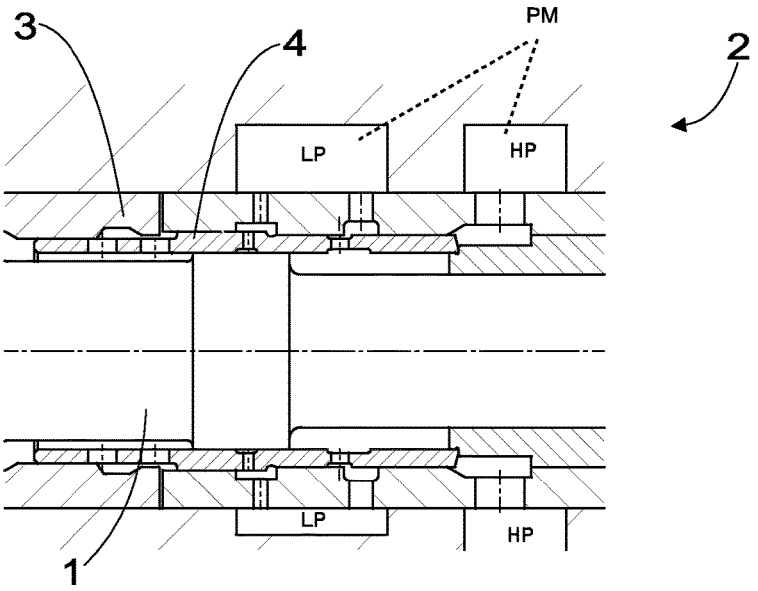
FIG. 1 is a cross-sectional view of a part of a rock drilling machine.

FIG. 1 shows a part of a rock drilling machine. The part of the rock drilling machine 2 is shown as an example only and the configuration of a rock drilling machine 2 including the percussion piston 1 described herein may vary depending on the embodiment in question. The rock drilling machine 2 includes a pilot cylinder 3, a sleeve-type distributor 4 and a pressure medium PM. The percussion piston 1 moves due to the pressure of the pressure medium and the work area(s) of the percussion piston that the pressure medium affects on in an impact direction A in relation to the pilot cylinder 3 causing an impact on a tool.

Pilot cylinder 3 is a cylinder provided within a frame of the rock drilling machine 2, and within which the percussion piston 1 is arranged to move. The pilot cylinder 3 may be a cylinder structure separate from the frame of the rock drilling machine 2 and arranged within the frame or the pilot cylinder 3 may be formed at least partially as a part of the rock drilling machine frame itself.

After the impact, the percussion piston 1 returns to its rear position in relation to the pilot cylinder 3, moving in a return direction B opposite to the impact direction. Thus, directions A and B are substantially parallel to the longitudinal direction of the pilot cylinder 3, which is also substantially parallel to the axial direction of the pilot cylinder 3. Then, a new work cycle of the rock drilling machine can start. The distributor 4 includes channels controlling the flow of the pressure medium between the different spaces formed between the percussion piston 1 and the pilot cylinder 3 and other parts of the hydraulic system of the rock drilling machine 2 to control the work cycle of the percussion piston and, thus, the rock drilling machine 2.

The distributor 4 can move in relation to the pilot cylinder 3 at least from a first state to a second state, whereby the flow of the pressure medium and thereby the works cycle of the percussion piston 1 and the rock drilling machine 2 may be controlled. More specifically, the percussion piston 1 has a control edge 5 configurable to cause a change in the position of the distributor in a direction parallel to the axial direction of the percussion piston 1 as the percussion piston moves in the impact direction in relation to the pilot cylinder. According to an embodiment, in the first state, a connection may open between a high-pressure space of the hydraulic system of the rock drilling machine 2 and the work space; and in the second state, a connection may be open between the works space and the tank.

The control edge can be any edge, surface or the like provided on a moving and/or stable part of the rock drilling machine 2 that can, while the percussion piston is moved in the impact direction A or in a return direction B in relation to the pilot cylinder 3, change the flow of the pressure medium, thereby affecting a state change of the distributor 4. The state change of the distributor 4 can be achieved for instance by opening and closing duct(s) and/or channel(s) connecting spaces formed between the pilot cylinder 3 and the percussion piston 1 by the geometries of the pilot cylinder 3 and the percussion piston 1, other high-pressure and low-pressure spaces of the hydraulic system of the rock drilling machine 2 and the work area(s) of the distributor 4.

In other words, control edges may be used to mechanically couple pressure medium flow to the movement of percussion piston 1 in relation to the pilot cylinder 3, thus providing mechanical control for timing changes in pressure medium flow and, thereby, changes in rock drilling machine work cycle phases, such as in the state changes of the distributor 4. A working principle of such a rock drilling machine 2 is known to a person skilled in the art and is therefore not explained here in more detail.

Figure 2:
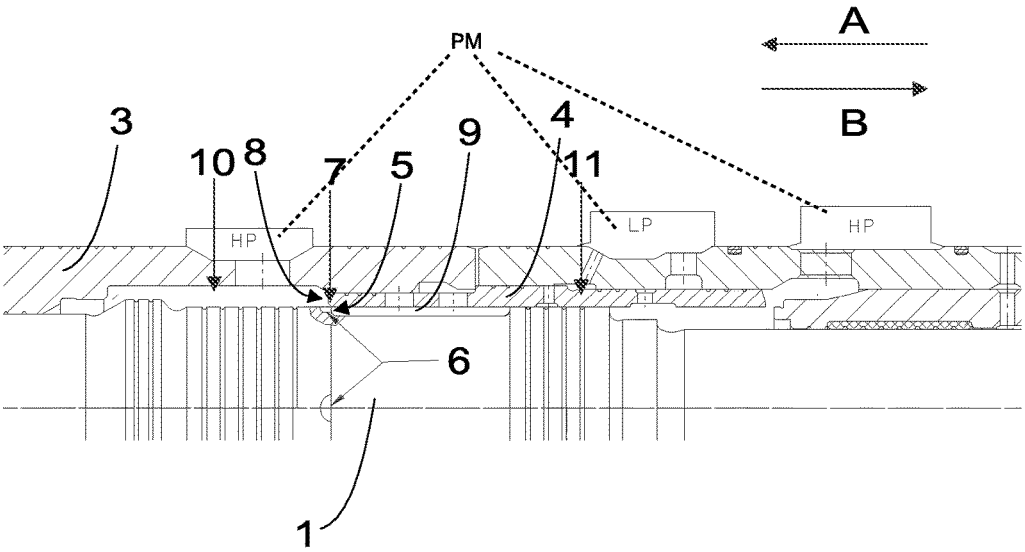
FIG. 2 is schematic partial cross-section of a part of a rock drilling machine.

FIG. 2 illustrates schematically a part of rock drilling machine 2, wherein the control edge 5 of the percussion piston 1 includes at least one notch 6 provided on the outer periphery 7 of the control edge. In the embodiment of FIG. 2, the control edge 5 of the percussion piston 1 can have a back edge of a front flange 10 of the percussion piston 1. The notch 6 can be a cut or another type of a formation differing from a substantially sharp and continuous cylinder-like control edge 5. The control edge 5 provided with the notch 6 can be arranged to cause a start of a state change for a distributor 4 before the control edge 5 of the percussion piston 1 passes by a corresponding second control edge 8 provided on the distributor 4 or the pilot cylinder 3. This can be achieved by the notch 6 opening a cross-sectional area projected in the axial direction of the percussion piston 1, in other words in a direction parallel to the impact direction A, allowing the pressure medium to flow in the axial direction from a space between the pilot cylinder 3 and the percussion piston 1 to the distributor work area causing the distributor 4 to move in relation to the pilot cylinder 3 thereby changing the state of the distributor 4. This enables a smooth state change for the distributor 4 in a direction parallel to the axial direction of the percussion piston 1 when compared to conventional solutions without notches.

According to an embodiment, the notch 6 can be arranged to open a cross-sectional area projected in the axial direction of the percussion piston 1 that is equal to or greater than 1/50 of the cross-sectional distributor work area causing the start of a state change for the distributor before the control edge 5 of the percussion piston passes by the corresponding second control edge 8 provided on the distributor 4 or the pilot cylinder 3. According to an embodiment, this projected cross-sectional area is opened by the notch 0.5 mm before the control edge 5 of the percussion piston 1 passes by the corresponding control edge 8 provided on the distributor or the pilot cylinder, at the latest.

According to a further embodiment, the notch 6 can have a length extending in the longitudinal direction of the percussion piston 1, which is substantially parallel to the impact direction A, that is longer than or equal to 0.5 mm from the control edge 5. A large enough notch in a cross-sectional area projected in the axial direction of the percussion piston 1 can enhance the smooth state change of the distributor 4 and reduce problems related to conventional solutions, such as cavitation. On the other hand, it also enables providing the control edge 5 further away from the tool end of the percussion piston 1, thus enabling the distributor 4 to change its state, for instance from the first state to the second state, later, slower and/or more smoothly. If there is no notch, but a conventional manufacturing related rounding or bevel, the cross-sectional area provided by the rounding or bevel before the control edge 5 passes by the second control edge 8 is not large enough to provide sufficient pressure medium flow for the distributor 4 state change to be affected.

In embodiments, where the shape of the percussion piston 1 is such that the control edge 5 does not have a flat surface part in the radial direction of the percussion piston 1, the control edge can be considered to comprise the position of the percussion piston 1 that is furthest away from the outer peripheral 7 of the control edge 5 and of such positions the one closest to the notch 6. Thus, the control edge 5 can be a first position of the percussion piston 1 providing the maximum cross-sectional area projected in the axial direction of the percussion piston 1 between the percussion piston 1 and the second control edge 8 provided on the distributor 4 or the pilot cylinder 3, that is the cross-sectional area available for the pressure medium flow, when the percussion piston 1 moves in impact direction A the notch 6 passing by the second control edge 8.

Figure 3:
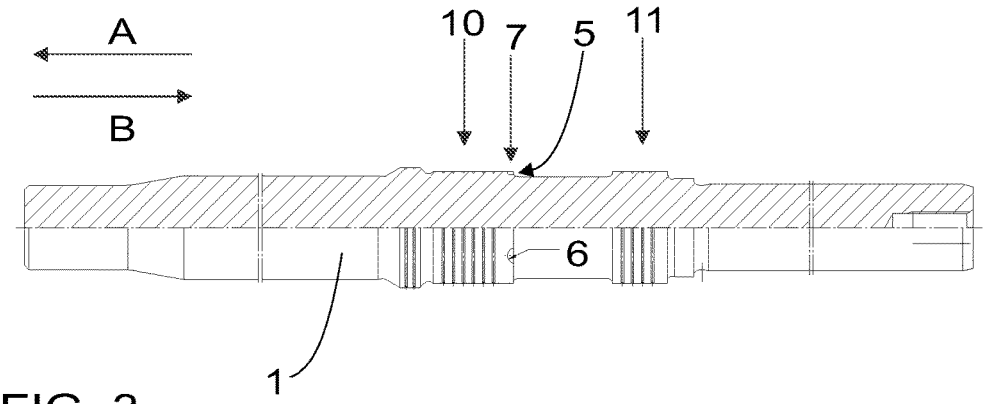
FIG. 3 is a partial cross-section of the percussion piston of the rock drilling machine.

According to an embodiment, the control edge 5 may have one notch 6. According to an embodiment, the notch 6 may extend along the whole outer peripheral 7 of the control edge 5. According to another embodiment, the notch may only extend along a part of the outer peripheral 7 of the control edge 5. According to yet another embodiment, the control edge 5 may have two or more such notches 6 extending along at least a part of the outer peripheral 7 of the control edge 5. The embodiment of FIG. 2 and/or FIG. 3 may have one, two, three or more of such notches 6. The notches 6 may be spaced equally along the outer peripheral 7 of the control edge 5 or in some other way depending on the embodiment. In embodiments where the notch(es) 6 only extend along a part of the outer peripheral, the notch 6 can have a length extending in the longitudinal direction of the percussion piston 1, which is substantially parallel to the impact direction A, that is longer than or equal to 2 mm from the control edge 5.

The geometry of the notch 6 can vary depending on the embodiment. The notch 6 can have for instance a groove, such as in FIG. 3, a rounding, such as in FIG. 4*a*, or a bevel, such as in FIG. 4*b*, and it can extend along at least a part of the outer peripheral 7 of the control edge 5 of the percussion piston 1. For example, the geometry of the notch 6 can be sharp, with the cross-sectional profile of the notch 6 being rectangular or triangular; rounded, with the cross-section being round or elliptical, or a combination thereof, the cross-section being U-shaped, as long as the combined cross-sectional area of the one or more notches 6 projected in axial direction of the percussion piston 1 can allow a sufficient amount of pressure medium to flow through the notch 6 to cause a start of a state change of a distributor 4 by moving the distributor 4 in in a direction parallel to the axial direction of the percussion piston 1. In the embodiment of FIG. 2, the distributor 4 may be moved in a return direction B. In another embodiment, the distributor 4 may n be moved in the impact direction A.

According to an embodiment, the at least one notch 6 or the two or more notches 6 may be formed in such a way that the cross-sectional area projected in the axial direction enlarges gradually as the percussion piston 1 moves in impact direction A in relation to the pilot cylinder 3. This can be achieved, for instance, by forming each notch 6 in such a way that the cross-sectional area of the notch at the end of the notch closest to the tool-side end of the percussion piston 1 is smaller than the cross-sectional area of the notch at the control edge 5 end of the notch 6. This way a gradual increase in the pressure medium flowing through the notch (es) can be provided, thus enabling a gradual opening of the notch(es) for the pressure medium. This can provide an even smoother state change of the distributor 4.

Figure 4A:
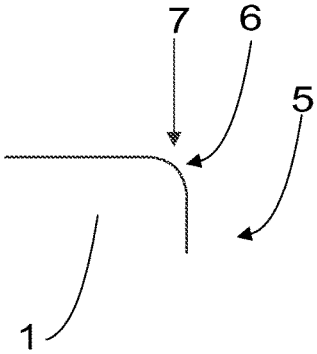
FIGS. 4*a*, 4*b*, 4*c* and 4*d* illustrate enlarged details of percussion pistons.
Figure 4B:
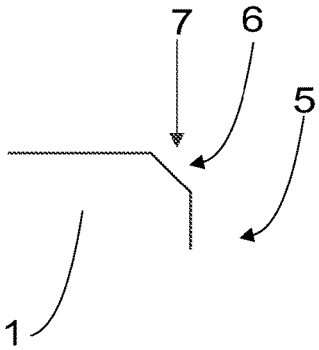
Figure 4C:
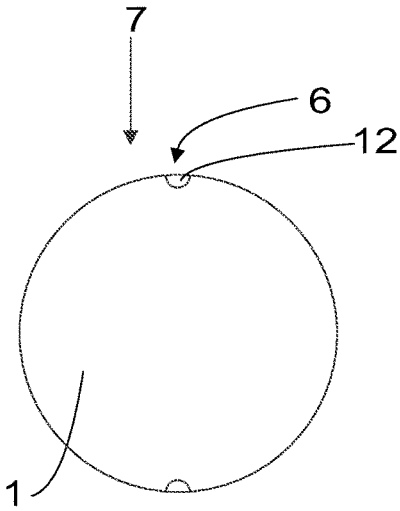
Figure 4D:
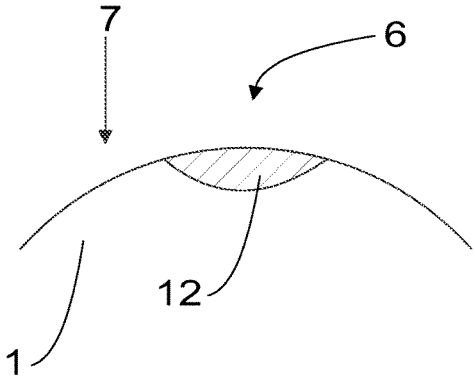

FIGS. 4*a* and 4*b* illustrate notches 6 shown schematically in cross-section from the side of the percussion piston 1. FIGS. 4*c* and 4*d* illustrate other notches in percussion pistons 1 shown schematically in cross-section from the control edge 5 towards the tool-side end of the percussion piston 1. FIG. 4*c* shows an embodiment with two notches 6.

FIG. 4*d* shows a detail of the percussion piston 1 having a notch 6. At the moment the second control edge 8 passes the position of the cross-section shown in FIG. 4*d*, the notch 6 can open a cross-sectional area 12 projected in the axial direction of the percussion piston 1, as shown hatched in FIG. 4*d*. The geometry of the notch 6 may vary in different embodiments. Also, the cross-sectional area 12 projected in the axial direction of the percussion piston that the notch 6 can open may vary along the length of the notch 6.

According to an embodiment, the control edge 5 of the percussion piston 1 is arranged in such a way that a zero advance in relation to the corresponding control edge 8 provided on the distributor 4 or the pilot cylinder 3 can be arranged at impact point, in other words at the position of the percussion piston 1 in relation to the pilot cylinder 3 at the moment an impact takes place.

Figure 5:
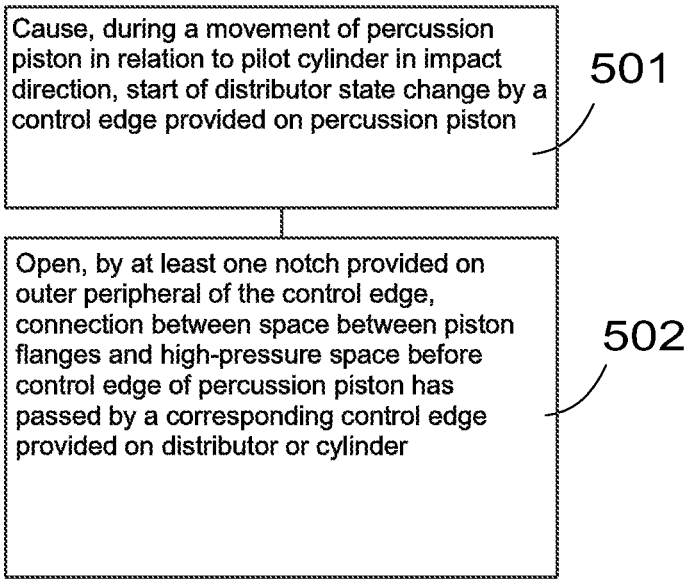
FIG. 5 is a flow diagram of a method for changing a state for a distributor of a rock drilling machine.

FIG. 5 illustrates schematically a method for changing a state for a distributor 4 of a rock drilling machine 2. The rock drilling machine can include a pilot cylinder 3, a sleeve-type distributor 4, a percussion piston 1 and a pressure medium. The percussion piston 1 may have a percussion piston 1 according to an embodiment described herein or a combination of features of the embodiments.

The method according to FIG. 5 includes the steps of causing 501, during a movement of the percussion piston 1 in relation to the pilot cylinder 3 in impact direction A, a start of a distributor state change by a control edge 5 provided on the percussion piston 1. The method may also include opening at step 502, by at least one notch provided on an outer peripheral 7 of the control edge 5, a connection between a space 9 formed between the piston flanges 10, 11 and a high-pressure space before the control edge 5 of the percussion piston 1 has passed by a corresponding control edge provided on the distributor or the pilot cylinder.

According to an embodiment, the notch 6 can open a cross-sectional area projected in the axial direction of the percussion piston 1 that is equal to or greater than 1/50 of the cross-sectional distributor work area causing the start of the state change for the distributor 4 before the control edge 5 of the percussion piston 1 passes by the corresponding control edge 8 provided on the distributor 4 or the pilot cylinder 3.

According to an embodiment, pressure medium can be directed at impact point of the percussion piston through at least one notch provided on the control edge of the percussion piston to change the state of the distributor in a direction parallel to the axial direction of the percussion piston 1.

According to an embodiment, the method can further include directing pressure medium in a first phase of an impact phase of the work cycle of the rock drilling machine 2 through at least one notch 6 provided on the control edge 5 of the percussion piston 1 to change the state of the distributor 4 in a direction parallel to the axial direction of the percussion piston 1. Then, the method can further comprise directing pressure medium in a second phase of the impact phase of the work cycle of the rock drilling machine 2, said second phase following said first phase, passed the entire control edge in such way that the position of the distributor 4 in a direction parallel to the axial direction of the percussion piston 1 is changed.

Although the present embodiment(s) has been described in relation to particular aspects thereof, many other variations and modifications and other uses will become apparent to those skilled in the art. It is preferred therefore, that the present embodiment(s) be limited not by the specific disclosure herein, but only by the appended claims.

What is claimed is:

1. A percussion piston for a rock drill machine, the machine including a pilot cylinder, a sleeve-type distributor and pressure medium, the percussion piston comprising a control edge configured to change in a position of the distributor in a direction parallel to an axial direction of the percussion piston as the percussion piston moves in an impact direction in relation to the pilot cylinder, wherein the control edge of the percussion piston includes at least one notch provided on an outer periphery of the control edge and arranged to start a state change for the distributor before the control edge of the percussion piston passes by a corresponding control edge provided on the distributor or pilot cylinder.

2. The percussion piston according to claim 1, wherein said control edge of the percussion piston includes a back edge of a front flange of the percussion piston.

3. The percussion piston according to claim 1, wherein said at least one notch includes a groove, a rounding or a bevel extending along at least a part of the outer peripheral of the control edge of the percussion piston.

4. The percussion piston according to claim 1, wherein the at least one notch is arranged to open into a cross-sectional area projected in the axial direction of the percussion piston corresponding to at least 1/50 of the cross-sectional distributor work area causing the start of a state change for the distributor before the control edge of the percussion piston passes by the corresponding control edge provided on the distributor or the pilot cylinder.

5. The percussion piston according to claim 4, where the projected cross-sectional area is opened by the notch before the control edge of the percussion piston passes by the corresponding control edge of the distributor or pilot cylinder.

6. The percussion piston according to claim 5, where the projected cross-sectional area is opened by the notch at the latest 0.5 mm before the control edge of the percussion piston passes by the corresponding control edge provided on the distributor or the pilot cylinder.

7. The percussion piston according to claim 1, wherein the control edge of the percussion piston includes at least two notches provided on the outer peripheral of the control edge.

8. The percussion piston according to claim 1, wherein the control edge of the percussion piston has a zero advance in relation to the corresponding control edge provided on the distributor or pilot cylinder at an impact point.

9. A rock drilling machine comprising a pilot cylinder, a sleeve-type distributor and a percussion piston, the percussion piston including a control edge configured to change in a position of the distributor in a direction parallel to an axial direction of the percussion piston as the percussion piston moves in an impact direction in relation to the pilot cylinder, wherein the control edge of the percussion piston includes at least one notch provided on an outer periphery arranged to start a state change for the distributor before the control edge of the percussion piston passes by a corresponding control edge provided on the distributor or pilot cylinder.

10. A method for changing a state for a distributor of a rock drilling machine, the rock drilling machine including a pilot cylinder, a sleeve-type distributor, a percussion piston and a pressure medium, the method comprising the steps of:

causing, during a movement of the percussion piston in relation to the pilot cylinder in an impact direction, a start of a distributor state change by a control edge provided on the percussion piston; and opening, by at least one notch provided on an outer peripheral of the control edge, a connection between a space between the piston flanges and a high-pressure space before the control edge of the percussion piston has passed by a corresponding control edge provided on the distributor or the pilot cylinder.

11. The method according to claim 10, wherein the control edge includes a back edge on a front flange of the percussion piston.

12. The method according to claim 10, wherein the at least one notch opens a cross-sectional area projecting in the axial direction of the percussion piston corresponding to at least 1/50 of the cross-sectional distributor work area causing the start of the state change for the distributor before the control edge of the percussion piston passes by the corresponding control edge provided on the distributor or pilot cylinder.

13. The method according to claim 10, further comprising directing pressure medium at impact point of the percussion piston through at least one notch provided on the control edge of the percussion piston to change the state of the distributor in a direction parallel to the axial direction of the percussion piston.

14. The method according to claim 10, further comprising directing pressure medium in a first phase of an impact phase of the work cycle of the rock drilling machine through at least one notch provided on the control edge of the percussion piston to change the state of the distributor in a direction parallel to the axial direction of the percussion piston, and directing pressure medium in a second phase of the impact phase of the work cycle of the rock drilling machine, said second phase following said first phase, past the entire control edge in such way that the position of the distributor is changed in a direction parallel to the axial direction of the percussion piston.

* * * * *